United States Patent [19]

Quarenghi

[11] 4,210,159

[45] Jul. 1, 1980

[54] TOBACCO TRIMMING DEVICE

[75] Inventor: Rodolfo Quarenghi, Bologna, Italy

[73] Assignee: CIR - S.p.A. - Divisione Sasib, Bologna, Italy

[21] Appl. No.: 926,231

[22] Filed: Jul. 20, 1978

[30] Foreign Application Priority Data

Jul. 25, 1977 [IT] Italy ..... 12708 A/77

[51] Int. Cl.[2] ..... A24C 5/18

[52] U.S. Cl. ..... 131/21 D; 131/84 C

[58] Field of Search ..... 131/84 C, 217

[56] References Cited

U.S. PATENT DOCUMENTS

| | | | |
|---|---|---|---|
| 3,032,041 | 5/1962 | Lanore | 131/84 C X |
| 3,089,497 | 5/1963 | Molins et al. | 131/21 D |
| 3,244,184 | 4/1966 | Petru | 131/84 C |
| 3,495,599 | 2/1970 | Molins | 131/84 C |
| 3,712,160 | 1/1973 | Preston et al. | 131/84 C |
| 3,769,989 | 11/1973 | Labbe et al. | 131/21 D |
| 3,880,171 | 4/1975 | Naylor | 131/84 C |

FOREIGN PATENT DOCUMENTS 1007097 10/1965 United Kingdom ..... 131/84 C

*Primary Examiner*—V. Millin

*Attorney, Agent, or Firm*—Spencer & Kaye

[57] ABSTRACT

In a cigarette making machine, a trimming device for the formation of a continuous tobacco braid which presents alternatively consecutive points having a differentiated tobacco density, comprises a pair of coplanar and tangent counterrotating disks. Each disk is provided with at least a pair of notches and each notch presents a height, with respect to the tobacco braid, which is different from the height of the immediately consecutive notch on the same disk. A trimming paddle wheel is arranged to cooperate with the two disks so as to trim from the braid the excess of tobacco projecting between the two discs at their point of tangency. The paddle wheel presents at least two sectors in which the radial length of the paddles is reduced correspondingly to the height of the notches. The paddles of the trimming paddle wheel are arranged inclined with respect to the longitudinal rotational axis of the paddle wheel itself.

1 Claim, 5 Drawing Figures

TOBACCO TRIMMING DEVICE

STATEMENT OF THE PRIOR ART

The following prior art is known to the applicant:

U.S. Pat. No. 3,032,041 (LANORE): the whole document;

U.S. Pat. No. 3,769,989 (LABBE): the whole document;

U.S. Pat. No. 3,880,171 (NAYLOR): the whole document;

U.S. Pat. No. 3,495,599 (MOLINS): FIGS. 1 and 8;

U.S. Pat. No. 3,089,497 (MOLINS): FIGS. 6 and 8;

U.S. Pat. No. 3,712,160 (PRESTON): the whole document.

BACKGROUND AND SUMMARY OF THE INVENTION

In cigarette making machines, a cut tobacco braid is continuously produced and subsequently wrapped in a paper tape, to form the so-called continuous rod from which the single cigarettes are cut.

Before being wrapped in the paper tape, the braid is adjusted in shape and size by means of an operation called trimming, during which tobacco threads exceeding a given braid section profile are cut away.

For this operation, trimmers are already known in which two knife disks, mounted coplanar and substantially tangent between each other, of equal diameter and counterrotating, cooperate with a rotating brush, which is driven around a shaft, which is inclined with respect to the tobacco braid feed axis, so that the tobacco braid advances on the trimming knife disks, substantially in the area of their line of tangency, while the brush passes close to the coplanar faces of said disks, in their point of tangency or where the disks are nearest to each other, and cuts the exceeding tobacco threads.

As an alternative to the rotating brush, a trimming element can be used which consistes of a wheel with straight radial paddles, that is, oriented parallelly to the wheel axis.

However, it has been found convenient not to proceed with the uniform braid trimming, but to leave a greater quantity of tobacco at those points of the braid, which wrapped in a continuous rod, will subsequently be cut into single cigarettes.

With this arrangement, the cut tobacco is denser at the ends of the single cigarettes, and this is obviously desired both because cut tobacco leakage from the ends is avoided and for a more uniform and nice looking outer appearance of the cigarettes.

In practice, when it is desired to trim the braid in such a way it presents uniformly interspaced denser areas, the disks present peripherally formed shaped areas, deeper than the plane of the respective disk. The rotation of the two disks is so timed that said deeper peripheral areas meet together periodically and consequently trimming in these areas leaves the braid denser.

If the rotary trimming element is a bristle brush, it is so arranged that the tips of the bristles inflect themselves on the disks at said deeper areas, where the projection is greater, while the bristles will just graze the other parts of the disks. When the trimming element is an oblique wheel with radial paddles, a certain number of consecutive paddles will have to be made lower than the others.

In addition, when the paddle wheel diameter, the pitch of the paddles, and their width have been established, the paddle wheel speed will have to be such that, when a paddle ceases its cutting action on the tobacco braid, the resumption of this action by the next paddle occurs at the cutting line defined by the outgoing paddle or, even better, slightly upstream of this line with a so-called overlapping effect.

With the above devices, an indifferentiated cigarette dense ending is obtained; in other words, this means that the greater cut tobacco density is substantially the same both at the tobacco end of the cigarette and at the end to be connected to the filter plug.

This invention aims to obtain a differentiated density of cigarette ends in such a way that the degree of density at the cigarette ends although being greater than the averge density of the cigarette body, is smaller at the cigarette end intended to be connected to the filter, and greater at the other end. This invention proposes an improved device for trimming the tobacco braid, in cigarette makers, comprising a pair of rotating disks mounted substantially coplanar and substantially tangent between each other, as well as of equal diameter and counterrotating in the direction of the feed axis of the tobacco braid which runs above them, while a trimming element shaped like a paddle wheel, oblique in relation to said feed axis, rotates grazing the disks from the bottom, synchronized and timed with said disks, the device consisting of disks equal to each other, where each disk has an even number of peripheral notches, angularly equidistant between each other, the notches of each disk being alternately formed with different depths while the paddle wheel has two opposite sectors comprising each a number of paddles having heights respectively commensurated with the alternate depths of said notches of the trimming disks so that, by opportunely timing the motions of the paddle wheel and of the disks, different trimming depths will be obtained, which produce a differentiated end density of the single cigarettes, said paddles being set inclined in relation to the axis of rotation of the paddle wheel so as to maintain the necessary overlapping effect in the trimming.

These and other features of the invention and the resulting advantages will be understood from the following detailed description of a preferred embodiment, given as a non restrictive example with reference to the attached drawings.

DESCRIPTION OF THE PREFERRED EMBODIMENT

Figure 1:
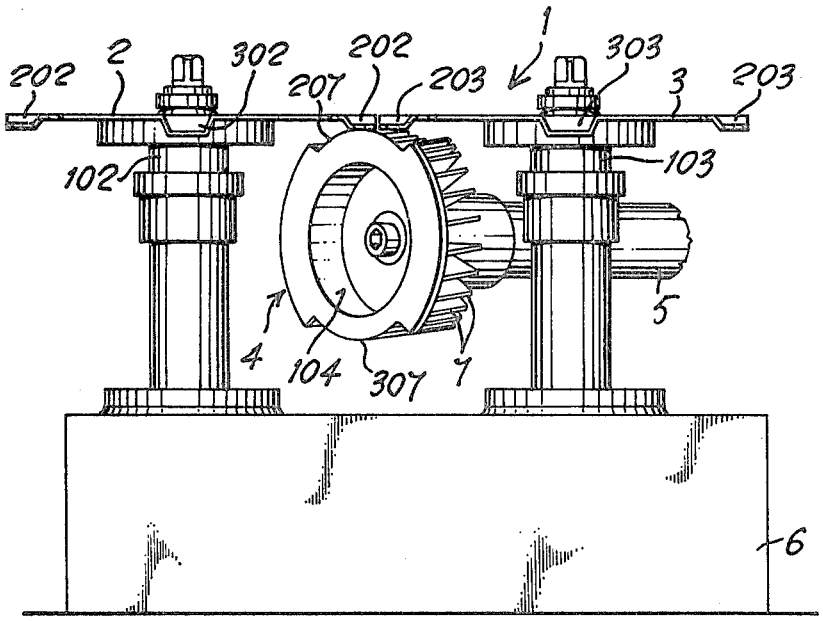
FIG. 1 is a perspective view of a trimmer according to the invention.
Figure 2:
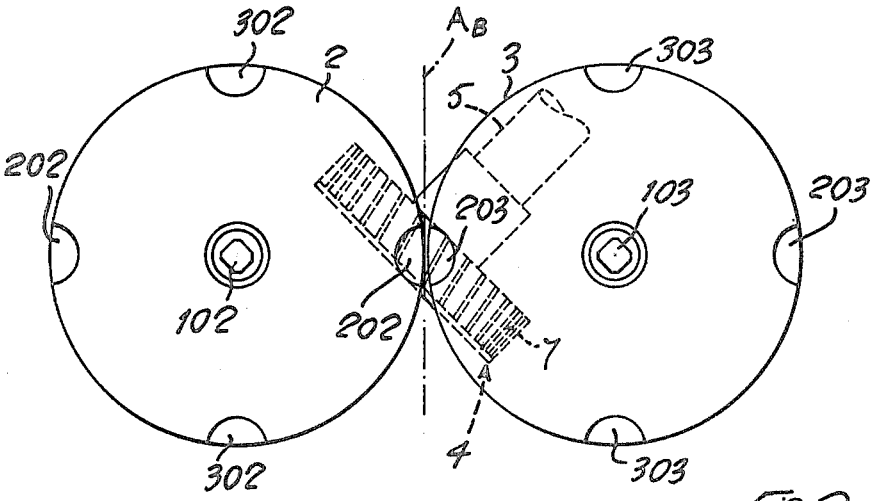
FIG. 2 is a diagrammatic top plan view of the trimmer of FIG. 1.

With reference to the drawings, and in particular to FIGS. 1 and 2, an improved trimmer 1 comprises a pair of rotary disks 2, 3. These disks, equal to each other and of equal diameter, are driven to rotate in opposite directions, and are mounted substantially coplanar and substantially tangent between each other in the braid feed axis direction.

Disks 2 and 3 cooperate in the trimming of said braid with a rotary trimming element which, in the embodiment illustrated, consists of a paddle wheel 4, mounted under the horizontal plane of he disks, with the axis of rotation 5 set obliquely in relation to the cut tobacco braid feed axis $A_B$.

The surfaces of disks 2 and 3, facing the paddle wheel 4, define the desired thickness for the braid, while said wheel trims out the surplus cut tobacco protruding from the disks at the slit (interspace) of tangency between them.

Disks 2 and 3 are fastened to the upper ends of respective driving shafts 102, 103 which project upwardly from an actuating box 6 having suitable devices for the trimming operation and for driving the disks in opposite directions. These devices are not specifically illustrated since they are known and, consequently, not essential for the understanding of the present specification, for which it is sufficient to add only that also the timing and the motion of the paddle wheel 4 depend from these devices, and are, therefore, connected with the movements of disks 2 and 3.

Feed axis $A_B$ of the braid-formed cut tobacco runs along the tangent common to disks 2 and 3, and paddle wheel 4 grazes peripherally the bottom of the disks, at their area of tangency and obliquely to the tangent itself.

To obtain an alternate interspaced trimming with different cut tobacco thicknesses, the trimmer presents constructive features, which will appear evident from what will be exposed hereinafter.

Each disk of the pair 2, 3 has peripherally an even number of semicircular recessed portions or notches 202, 302, 203, 303 angularly interspaced between each other in a regular manner. In the preferred embodiments illustrated and described there are four notches for each disk.

These notches, at the periphery of the respective disks, are alternatively made more or less deep, equally for each disk. As it appears from FIG. 1, the notches of pairs 202, 203 are less deep than those of pairs 302, 303, respectively alternated with them on disks 2 and 3. Furthermore, as it appears from FIG. 2, disks 2 and 3 are so timed between each other that the notches of equal depth 202, 203 and 302, 303 join each other in an orderly manner at the point of tangency, when the disks start rotating, and define in the tobacco braid passing in that area, interspaced sections having different trimming depths.

In operative correlation with the above described semicircular notch conformation of disks 2 and 3, paddle wheel 14, which constitutes the trimming element, has two seperate sectors 207, 307 in which paddles 7 are shorther in height in a manner corresponding to the two different depths of the notches of disks 2 and 3 respectively. More precisely, paddles 7 are less reduced in height in sector 207, corresponding to the less deep notches 202, 203, while they are more reduced in height in sector 307, corresponding to the deeper notches 302, 303. Obviously, the motion of paddle wheel 4 is timed with that of disks 2 and 3 in such a way that sector 207 cooperates with notches 202, 203 while sector 307 cooperates successively with notches 302, 303. Thus, in the illustrated case, in which the disks are each formed with two pairs of notches, with a 90° angular interspace, the wheel 4 must make two revolutions at every revolution the disks, since this wheel has now the two sectors 207, 307 to be alternately brought into association with the said pairs of disks. Thus, the speed of wheel 4, in the case of the trimming for differentiated density cigarette ends, with the same number of semicircular notches on calibrating disks 2, 3 will be reduced by half with respect to the one required to the same trimming, but not differentiated in thickness.

Due to this reduction by half of the speed of rotation of paddle wheel 4, the overlapping effect of paddles 7 (i.e. the continuity of their operative action on the trimming from the braid of the excess cut tobacco) can fail.

This overlapping failure inconvenience could be theoretically obviated by decreasing the pitch of paddles 7 on wheel 4, or by increasing correspondingly the width of the paddles. However, considerations of constructive difficulties oppose the reduction of the pitch of paddles 7, while the increase of the width of the paddles would lead to the paddle cutting action on lengths of excessively free tobacco braid, that is, not sufficiently contolled by disks 2, 3, with consequent irregularities in the cutting effect. Always theroretically, the cutting speed of trimming paddles 7 could be increased by increasing the height of the paddles and, consequently, the diameter of wheel 4. However, evident space requirements decidedly oppose this solution.

According to a main feature of this invention, in order to obviate the overlapping failure inconvenience in the trimming operation, on hub 104 of wheel 4, paddles 7 are not simply mounted according to radial planes, but are mounted inclined in relation to the axis of rotation 5 of the wheel. The effect of this inclination of the paddles in relation to a normal straight paddle wheel, appears clearly from the comparative examination of the diagrammatic schemes in FIGS. 3, 4, 5.

In these FIGS. $V_C$ is the cut tobacco braid feed speed along the feed line $A_B$, while reference numeral 4 shows schematically the paddle wheel, of which two consecutive paddles having a width L and paddle pitch p are indicated with 7. $V_F$ is the peripheral speed or cutting speed of wheel 4, while $V_R$ is the resultant of $V_F$ and of $-V_C$, i.e. it is the relative peripheral speed of paddles 7 in relation to the cut tobacco braid which advances along the direction $A_B$. This relative speed, as known, clearly illustrates the relative motion of paddles 7 in relation to the cut tobacco braid, supposing that the latter is stationary on line $A_B$.

Figure 3:
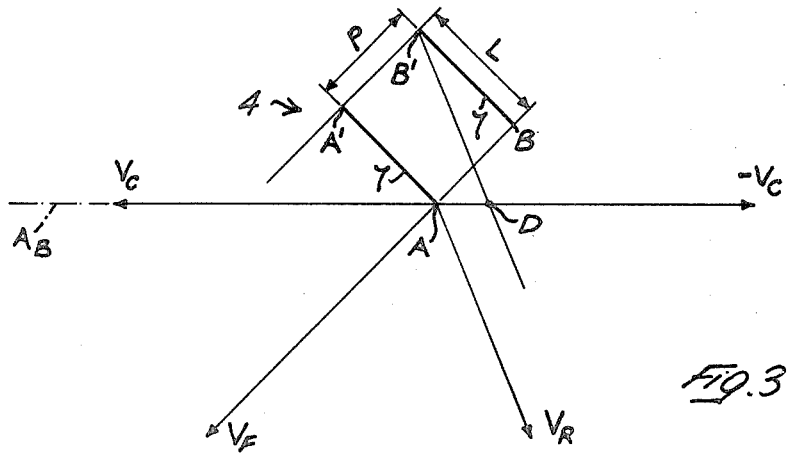
FIGS. 3, 4, 5, are vectorial schemes which sequentially illustrate the effect which the inclination of the trimming wheel paddles accomplishes in the trimming operation.
Figure 4:
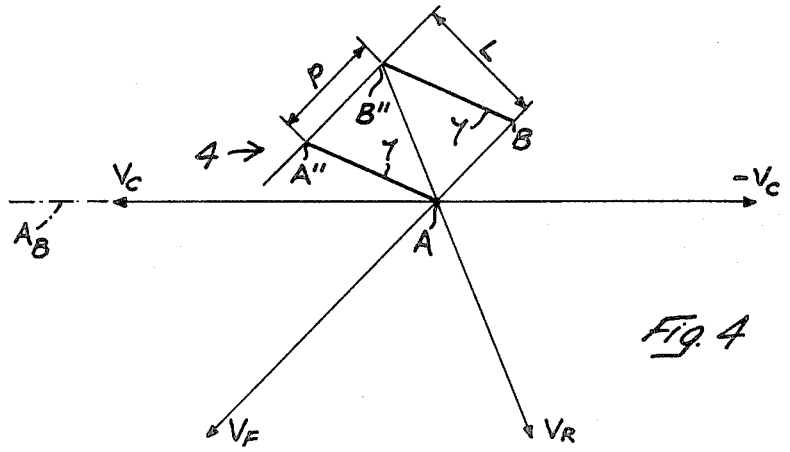

FIG. 3 illustrates the motion of a straight-paddle wheel, in the case in which, for a given proportion (L, p) of the paddles of wheel 4, the tangential speed VF, correlated with the braid feed speed VC, and with the admissible inclination for the shaft of wheel 4 on the braid feed direction $A_B$ is not sufficient to guarantee the trimming, not even with a minimum of overlapping margin. In this case, as it can be perceived by intuition, there remain untrimmed braid segments AD, alternated with the sections trimmed by the pass of consecutive paddles AA', BB'.

With a certain inclination AA'', BB'' of paddles 7 (FIG. 4), point D coincides with point A and the limit condition for the trimming continuity is thus obtained.

Figure 5:
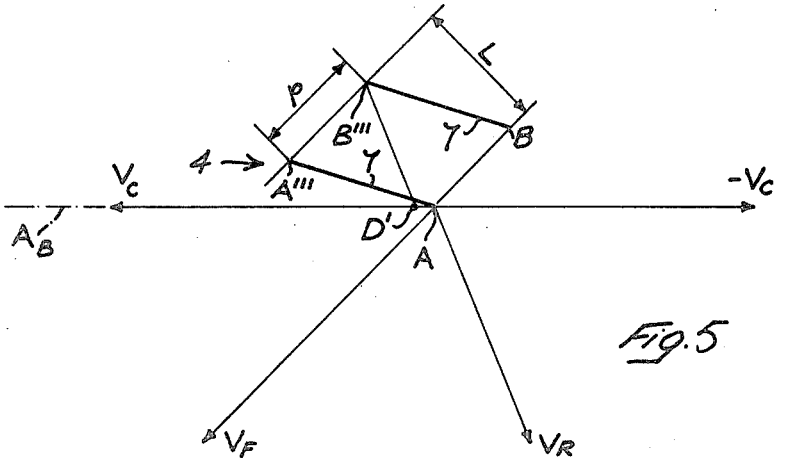

By further increasing the inclination of the paddles up to conditions AA''' and BB''' illustrated in FIG. 5, the trimming effect with covering is obtained, since now, as it can be intuitively perceived, section D'A, already passed by a paddle, it taken back during the pass of the next paddle, and this is the so-called covering effect (overlapping effect).

Thus, with a trimming wheel 4 with inclined paddles, according to the present invention, the desired covering is obtained, notwithstanding the reduction by half of the speed required by the differentiated-thickness trimming, without resorting to expedients, which could be of damage or practically not achievable or not advisable, such as the increase of the paddle width, the greater inclination of the wheel shaft on the braid axis, the increase of the wheel diameter, and/or the reduction of the paddle pitch.

It is understood that the invention is not limited to the embodiment which has been described as an example, but can be broadly changed or modified without departing from the broadest limits of the principle of the invention.

I claim:

1. In a cigarette making machine, a tobacco trimming device for the formation and trimming of a continuous tobacco braid which presents a greater density of tobacco at individual points corresponding to the cigarette ends, said device comprising means for conveying the tobacco braid along its longitudinal axis, a pair of counterrotating disks mounted substantially coplanar and substantially tagent to each other according to the said longitudinal axis of the tobacco braid, and a trimming paddle wheel, rotating in synchronism with the said disks and arranged to cooperate with the said disks in such a manner as to trim away from the tobacco braid the excess of tobacco projecting beyond the disks at their point of tangency, the paddles of the said trimming paddle wheel being arranged inclined with respect to the longitudinal rotational axis of the paddle wheel itself, said device futher comprising on each one of the two counterrotating disks at least a pair of peripheral notches of which one notch presents a height, with respect to the tobacco braid, which is different from the height of the immediately consecutive notch on the same disk, the two disks being arranged to rotate in timed relationship so that the notches of equal hieght will meet each other at the point of tangency of the two disks, while the trimming paddle wheel presents at least two sectors in which the radial length of the paddles is reduced correspondingly to the height of the notches in the disks, each sector of the paddle wheel cooperating with the corresponding equal height notches of the disks at their point of tangency, whereby the thus trimmed tobacco braid presents consecutive points having an alternatively differentiated density of tobacco.

* * * * *